US005139252A

United States Patent [19]

Morita et al.

[11] Patent Number: 5,139,252

[45] Date of Patent: Aug. 18, 1992

[54] PAPER-SUPPLYING DEVICE IN AN IMAGE-FORMING APPARATUS

[75] Inventors: Takakazu Morita, Osaka; Satoshi Yano, Takatsuki, both of Japan

[73] Assignee: Mita Industrial Co., Ltd., Osaka, Japan

[21] Appl. No.: 552,691

[22] Filed: Jul. 12, 1990

[30] Foreign Application Priority Data

Jul. 16, 1989 [JP] Japan ..... 1-83190
Jul. 16, 1989 [JP] Japan ..... 1-183476
Jul. 16, 1989 [JP] Japan ..... 1-183477

[51] Int. Cl.[5] ..... B65H 3/06

[52] U.S. Cl. ..... 271/117; 271/162; 271/164; 271/127

[58] Field of Search ..... 271/162, 163, 164, 160, 271/117, 110, 111, 170, 109, 113, 127, 241; 312/348; 271/126, 171

[56] References Cited

U.S. PATENT DOCUMENTS 3,387,907 6/1968 Wall ..... 312/348
3,768,805 10/1973 Kuksa ..... 271/126
4,098,501 4/1978 Tani et al. ..... 271/164 X
4,351,519 9/1982 Jendrick ..... 271/164 X
4,548,397 10/1985 Runzi ..... 271/121
4,748,516 5/1988 Harano et al. ..... 358/296
4,835,567 5/1989 Ogata ..... 271/164 X
4,953,037 8/1990 Ito et al. ..... 358/496

FOREIGN PATENT DOCUMENTS 0125538 7/1983 Japan ..... 271/109
0186841 10/1984 Japan ..... 271/10
0223747 11/1985 Japan ..... 271/109
0176737 7/1989 Japan ..... 271/110

*Primary Examiner*—H. Grant Skaggs
*Assistant Examiner*—Carol Lynn Druzbick
*Attorney, Agent, or Firm*—Wenderoth, Lind & Ponack

[57] ABSTRACT

A paper-supplying device in an image-forming apparatus includes a paper-supplying portion to be charged with a paper-housing vessel by moving the latter in a direction of a rotary axis of a shaft of a paper-supplying roller. The vessel is provided with paper-separating clicks for pressing paper at opposite corners thereof on a downstream side thereof in a paper-supplying direction of the paper and an energizing structure for lifting a carrier plate supporting the paper thereon upwardly toward the paper-separating clicks. The roller is movable in the direction of the rotary axis of the shaft thereof. Transfer structure lifts the vessel in an upwardly inclined direction to press the paper against the roller when the paper-supplying portion is charged with the vessel. A member, brought into contact with the vessel before a surface of the paper is brought into contact with the roller and moved in the direction of charging the vessel, is connected with the roller in a relatively rotatable manner. Position-returning structure returns the member to an initial position.

16 Claims, 9 Drawing Sheets

PAPER-SUPPLYING DEVICE IN AN IMAGE-FORMING APPARATUS

BACKGROUND OF THE INVENTION

1. Field of the Invention

The present invention relates to a paper-supplying device installed in an image-forming apparatus, such as an electrophotographic copying machine or a printer, in particular to a paper-supplying device in which a paper-supplying portion is charged with a paper-housing vessel by moving the latter in the direction of the rotary axis of a shaft of a paper-supplying roller.

2. Description of the Prior Art

In such paper-supplying device, if the paper-supplying portion is charged with the paper-housing vessel by moving the latter in the direction of the rotary axis of the shaft of the paper-supplying roller, a disadvantage occurs in that papers housed in the paper-housing vessel one above another are brought into contact with end face portions of the paper-supplying roller and can be torn or shifted sideways within the vessel.

An arrangement for eliminating such disadvantage has been proposed in Japanese Utility Model Application Laid-Open No. Sho 63-21630, wherein, as shown in FIG. 13, a paper-supplying device comprises a paper-supplying roller shaft 72, a paper-supplying roller 73 rotatable integrally with paper-supplying roller shaft 72 and movable in the direction of the axis thereof, and a paper-supplying roller holding member 74 relatively rotatably mounted on paper-supplying roller 73 and extending therefrom to project into the path of a vessel 71 containing or housing therein paper sheets during the time when a paper-supplying portion is charged with the paper-housing vessel 71. Holding member 74 is engaged by vessel 71 and moves together with the vessel 71, thereby moving the roller 73 along the shaft 72 during the time when the paper-supplying portion is charged with the vessel 71. Pressing force-applying means 75 applies pressing force pressing the paper within the vessel 71 against the roller 73 after the engagement of the vessel 71 with the holding member 74.

With such the construction, when the paper-supplying portion is charged with the vessel 71, the paper within the vessel 71 is separated from the roller 73 before the engagement of the vessel 71 with the holding member 74. However, upon charging the paper-supplying portion with the vessel 71, the vessel 71 is moved integrally with the roller 73 and the paper within the vessel 71 is pressed against the roller 73 by means of the pressing force-applying means 75, after the engagement of the vessel 71 with the holding member 74 (refer to FIG. 14) and, thus the paper effectively can be prevented from being torn and shifted sideways.

However, various sizes, for example calling card size to A0 size in JIS, of paper may be housed in the vessel 71 one above another, and thus the weight of the papers housed in the vessel 71 greatly varies. On the other hand, the force of means 75 pressing the paper against the roller 73 is constant, so that a disadvantage has occurred in that the actual force with which the paper is pressed against the roller 73 is greatly varied, depending on the size of the paper to be supplied. Therefore, the paper-supplying capacity for certain sizes of paper is remarkably reduced.

In addition, in for example an electrophotographic copying machine provided with the above described paper-supplying device in which the paper-supplying portion is charged with the paper-housing vessel by moving the latter in the direction of the rotary axis of the shaft of the paper-supplying roller, in the event that there occurs a shift of the optical axis between the manuscript and the paper on which images from the manuscript are to be copied, (a positional shift between the manuscript and the paper in a direction meeting at a right angle with the paper-supplying direction, more strictly the positional shift between the image-forming portion and the manuscript or the paper in the direction of the width of the latter), the manuscript-placing standard plate provided at an end portion of a contact glass is shifted in the direction of the width of the manuscript to change the standard position of placement of the manuscript relative to the image-forming portion and thus the paper. This achieves regulation of the optical axis between the manuscript and the paper.

However, in the case of the paper-supplying device provided with a plurality of paper-supplying portions adapted to be charged with paper-housing vessels in the directions of the rotary axes of shafts of the rollers, centers in the direction of width of the papers are inevitably shifted in position in every paper-housing vessel charged into the respective paper-supplying portions due to the slight shift in position between each paper-supplying portion and each paper-housing vessel, differences in the length of the paper-supplying course and the paper-supplying mode or errors in assembly of the device. Thereby, the regulation of the optical axes of the papers within the paper-housing vessels charged into a plurality of paper-supplying portions has been impossible by means of the above described manuscript-placing position regulating means.

In addition, paper-supplying roller shaft of the paper-supplying device adapted to be charged with the paper-housing vessel in the direction of the rotary axis of the shaft of the paper-supplying roller is provided with at least one paper-supplying roller, and the shaft provided with the roller removed from the body of the paper-supplying device when a worn paper-supplying roller is exchanged and other maintenance are conducted.

In order to take the paper-supplying roller shaft out of the body of the paper-supplying device, the connection of the paper-supplying roller shaft with the driving means is cancelled and a ball bearing supporting the paper-supplying roller shaft is removed. However, such operation of removing the paper-supplying roller shaft is remarkably difficult and troublesome and also a subsequent assembly operation likewise is difficult.

The present applicant has proposed a device, as shown in FIG. 15, in which a paper-supplying roller shaft 82 provided with a paper-supplying roller 81 is divided in the vicinity of both sides of roller 81, divided roller shafts 82*a*, 82*b* being overlapped one upon another at axial ends thereof, and the divided roller shafts 82*a*, 82*b* being connected with each other by means of screws 83 at such overlapped portions. Thereby, the divided shafts 82*a*, 82*b* provided with the roller 81 easily can be installed and detached by the simple operation of merely setting or removing screws 83. This arrangement is disclosed in Japanese Utility Model Application Laid-Open No. Sho 63-90646.

However, this device still has need for improvement in that in order to prevent roller 81 from being rotated and swung, a highly accurate processing technique for coinciding the axes of shafts 82*a* and 82*b* is required, and the cost is increased due to an increase in the number of parts.

SUMMARY OF THE INVENTION

The present invention has been achieved in view of the above described actual circumstances, and it is a first object of the present invention to provide a paper-supplying device wherein a paper-supplying portion is charged with a paper-housing vessel by moving the latter in the direction of the rotary axis of the shaft of a paper-supplying roller, capable of providing an appointed pressing force depending on the size of the paper to be supplied without producing tearing and sideways shifting of the paper in the same manner as in the conventional device.

It is a second object of the present invention to provide a paper-supplying device capable of easily achieving regulation of an optical axis between the papers in a plurality of paper-supplying portions and a manuscript.

It is a third object of the present invention to provide a paper-supplying device whereby it is easy to install a paper-supplying roller on a paper-supplying roller shaft and to detach the paper-supplying roller from the paper-supplying roller shaft.

In order to achieve the above described first object, according to the present invention there is provided a paper-supplying device of an image-forming apparatus wherein a paper-supplying portion is charged with a paper-housing vessel by moving the latter in the direction of the rotary axis of a shaft of a paper-supplying roller. The paper-housing vessel is provided with paper-separating clicks for pressing both corners at a downstream side of the paper in the paper-supplying direction, and energizing means for lifting up a plate supporting the paper thereon toward the paper-separating clicks, while the paper-supplying roller is adapted to be movable in the direction of the rotary axis of the shaft thereof. Moving means lift the paper-housing vessel upwardly in an oblique direction and presses a surface of the paper against the paper-supplying roller after said paper-supplying portion is charged with the paper-housing vessel. A member is brought into contact with the paper-housing vessel before the surface of the paper is brought into contact with the paper-supplying roller and is moved in the direction of charging. The member is connected with the paper-supplying roller to move the same. Position-returning means returns the member to an initial position.

In order to achieve the second object, according to the present invention there is provided a paper-supplying device in an image-forming apparatus wherein a paper-supplying portion is charged with a paper-housing vessel by moving the latter in the direction of the rotary axis of the shaft of a paper-supplying roller. The vessel is supported at four points, that is two points on opposite sides of the downstream end of the vessel, in the vessel-charging direction, and two points on opposite sides on the upstream end of the vessel, in the vessel-charging direction. Each support point is by a support structure including a roller and a supported member. At least one set of support structures is adapted to suppress movement of the vessel in the charging direction thereof when the paper-supplying portion is being charged with the vessel. The supported member or the roller is adapted to be shifted in position in the charging direction of the vessel and fixed.

In order to achieve the third object, according to the present invention there is provided a paper-supplying device in an image-forming apparatus wherein a paper-supplying portion is charged with a paper-housing vessel by moving the latter in the direction of the rotary axis of a shaft of a paper-supplying roller. Both ends of a shaft, provided thereon with the roller fixedly mounted thereon so as to be pulled out in the axial direction, are pivoted on a pair of support members through respective bearings. A distance from an inner surface on the side of one of the support members to a shaft end on the other side of the shaft is smaller than a distance between inner surfaces of the pair of support members. That bearing supporting the shaft end on the other side of the shaft is adapted to be pulled out of the support member on such other side.

According to the first invention, during the process of charging the paper-supplying portion with the paper-housing vessel, the vessel is lifted up toward the paper-supplying roller while the paper-housing vessel is moved in the charging direction thereof integrally with the paper-supplying roller. Thereby, the paper, which has been under a noncontact condition, is pressed against the paper-supplying roller. Also, the paper-housing vessel itself is provided with energizing means for pressing the paper against the paper-supplying roller, so that a pressing force corresponding to the size of the paper housed in every paper-housing vessel can be imparted to the surface of the paper.

According to the second invention, the position of the paper supplied to the image-forming portion in the direction of the width can be changed by changing the position of at least one set of support structures in the charging direction of the paper-housing vessel, that is the direction of the rotary axis of the shaft of the paper-supplying roller. Thus, the regulation of an optical axis between a manuscript and the paper can be achieved.

According to the third invention, one end or side of the paper-supplying roller shaft freely hangs down, with the bearing on the opposite end or side as a center by pulling out the bearing supporting the shaft end on the one side of the shaft. Thus, the paper-supplying roller can be pulled out from the shaft in this hung-down position.

Alternatively, if the distance from the shaft end at the one side of the shaft to the inner surface of the support member on such side is larger than a length in the direction of the rotary axis of the shaft of the roller, the paper-supplying roller can be pulled out through a space between such shaft end and such support member. In addition, the paper-supplying roller shaft can be installed by procedures opposite to the above described operation.

DESCRIPTION OF THE PREFERRED EMBODIMENTS

Preferred embodiments of the present invention will be described below with reference to the drawings.

Figure 1:
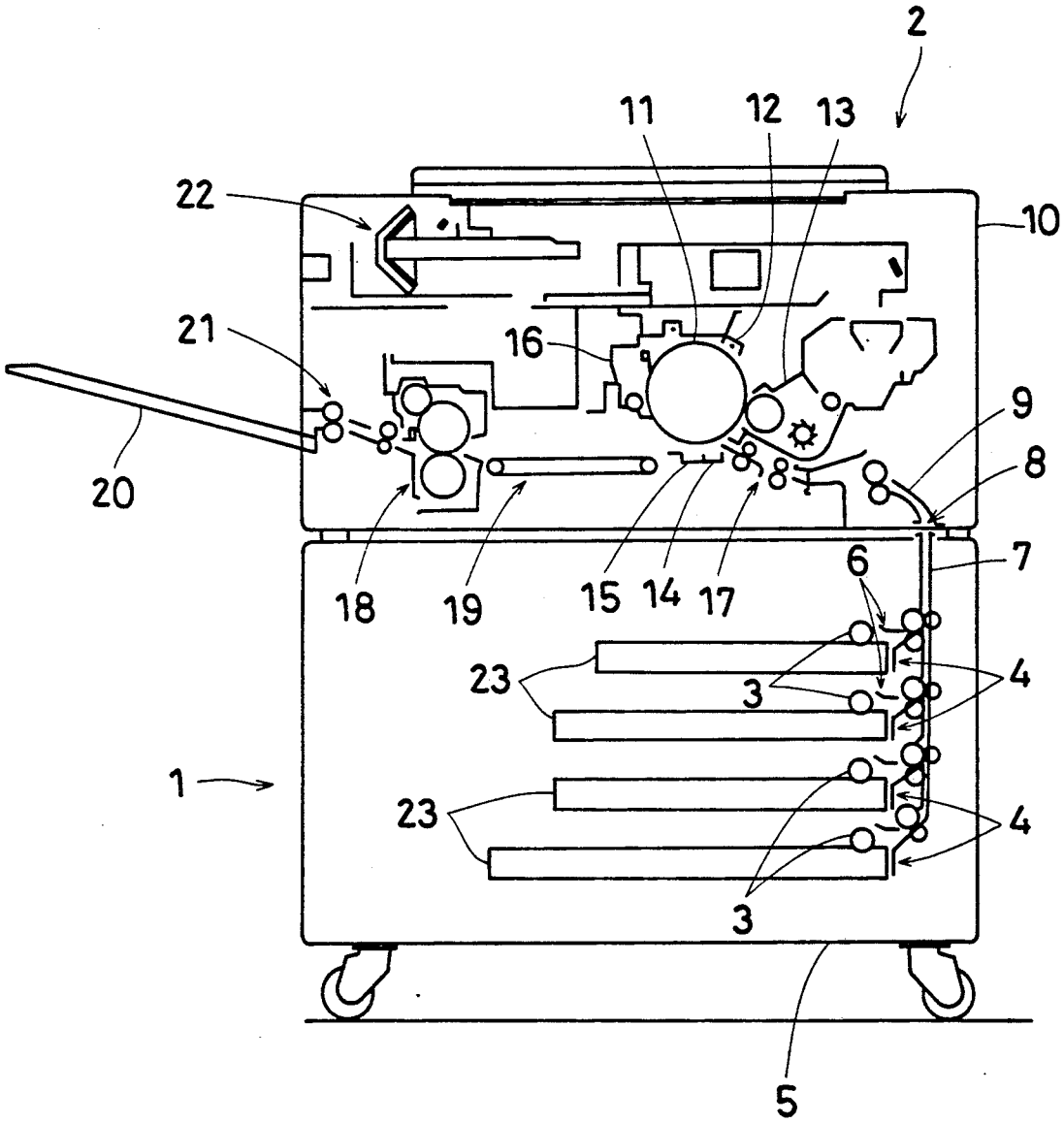
FIG. 1 is a schematic longitudinally sectioned side view showing an image-forming apparatus.

FIG. 1 shows an image-forming apparatus, for example an electrostatic photographic copying machine, comprising a paper-supplying desk or housing 1 and a body 2 of the image-forming apparatus carried on paper-supplying desk 1.

Paper-supplying desk 1 comprises a mobile rack or stack 5 provided with a plurality of vertically spaced arrangements or stages defining paper-supplying portions 4, each having a paper-supplying roller 3. Paper-supplying passages 6 from the respective stages of paper-supplying portions 4 are joined together to form a joined paper-supplying passage 7 defining a paper delivery port 8 on one side in an upper portion of rack 5.

Body 2 of the image-forming apparatus is provided in a lower portion of a case 10 thereof with a paper-supplying passage 9 communicating with port 8 of paper-supplying desk 1 when the body 2 of the image-forming apparatus is mounted on paper-supplying desk 1. A photoreceptor 11 is installed in case 10. A charging device 12, a developing device 13, a transfer device 14, a paper-separating device 15 and a cleaning device 16 are arranged around photoreceptor 11. A paper-conveying passage 17 extends from paper-supplying passage 9 to paper-transfer device 14. A paper-conveying passage 19 supplies a fixing device 18 with paper which has been transferred and separated. A paper-delivery roller 21 delivers paper which has been fixed to a paper-delivery tray 20. An optical system-movable type exposing device 22 is arranged in an upper space of case 10.

Each of the plurality of stages of paper-supplying portions 4 of desk 1 are adapted to be charged with a respective vessel 23 containing or housing sheets of paper. Each vessel 23 is movable in a direction of a rotary axis P of a shaft of the respective paper-supplying roller 3, as shown in FIGS. 2 to 5.

Vessel 23 has a construction as shown in FIG. 2 and FIGS. 6 to 9. That is to say, a carrier plate 24 is provided within a case of body 23*a* of the paper-housing vessel 23 so as to be movable relative to the axis P of the shaft of roller 3 (hereinafter referred to as the direction P of charging or pulling out the paper-housing vessel in case of need). A paper end-regulating plate 25 is provided on the upstream end, relative to the direction Q of paper supply, of carrier plate 24 and on side portions thereof. Paper-separating tabs or clicks 26 act on opposite corners on the downstream side in the paper-supplying direction of said paper (a) stacked on plate 24. Paper-supplying direction Q extends at a right angle with the directions of charging and pulling-out of the paper-housing vessel 23. Energizing means 27 presses and lifts upwardly that end of carrier plate 24 at which paper-separating clicks 26 are provided. Carrier plate 24 has therethrough an opening (b) through which falls a paper-absence detecting sensor 29 when the papers (a) have been exhausted from plate 24.

Rollers 30 are rotatable mounted on opposite sides of vessel 23, at the downstream end thereof in the direction of charging the vessel into portion 4. Cam surfaces or members 31, inclined rearwardly and downwardly relative to the direction of charging of vessel 23, are provided at opposite sides of vessel 23 at the upstream thereof.

Figure 8:
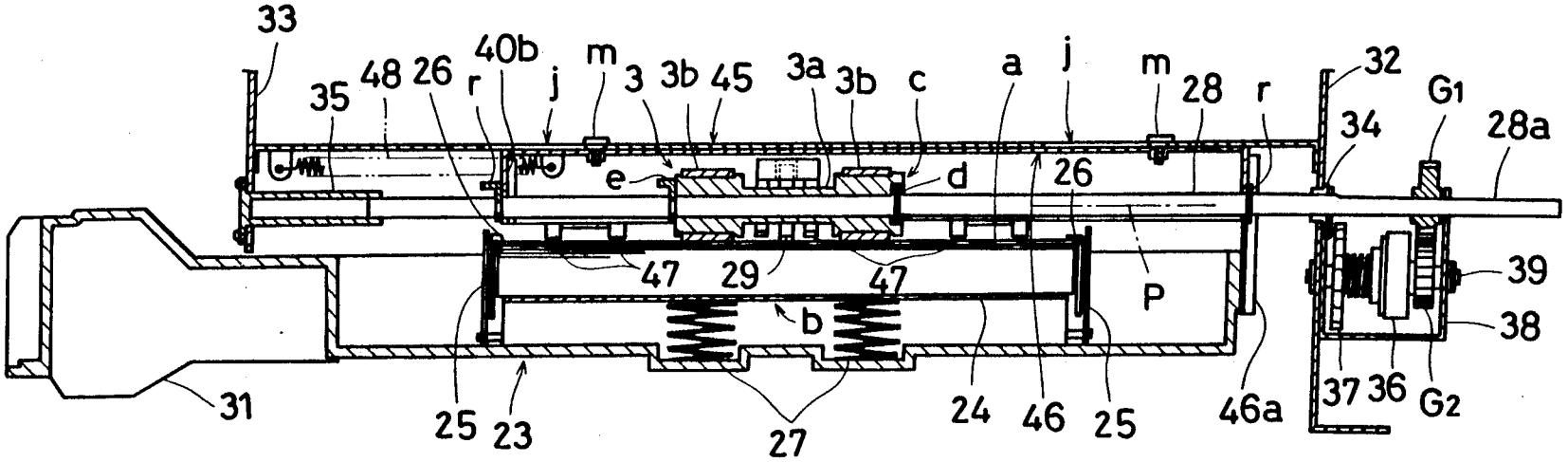

As shown in FIG. 8, paper-supplying roller 3 comprises a roller body 3*a* having a smaller diameter middle portion in the longitudinal direction thereof and larger diameter opposite end portions and roller members 3*b* made of rubber formed on the larger diameter end portions. Roller body 3*a* if provided at one end thereof with an engaging concave recess (c).

A paper-supplying roller shaft 28 supporting paper-supplying roller 3 is provided with a spring pin (d), which is engaged in concave recess (c) of roller 3 to integrally hold roller 3. A slip-preventing member (e) (one example of slip-preventing means) made of resin for preventing roller 3 from slipping on shaft 28. Shaft 28 is rotatably mounted in cynlindrical bearings 34, 35 mounted on a pair of support members 32, 33 on the sides of case 10 so that shaft 28 is rotatable around and slidable in the direction of the axis P.

Figure 2:
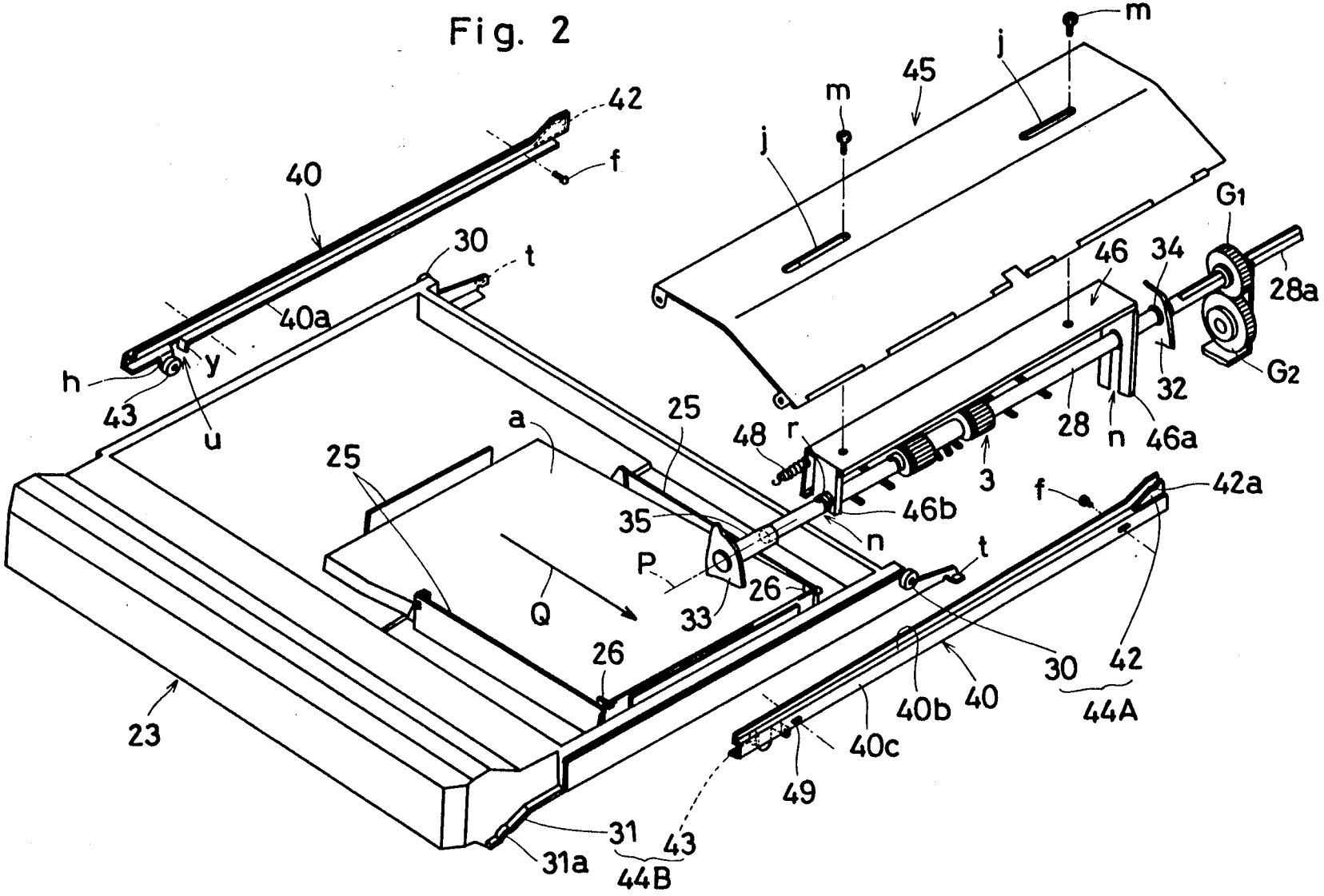
FIG. 2 is a perspective view showing a disassembled paper-supplying device together with a paper-housing vessel.

Referring to FIGS. 2 and 8, reference numeral $G_1$ designates an input gear on a shaft portion 28*a* at one end of shaft 28 that projects from bearing 34. Input gear $G_1$ may be provided on shaft portion 28*a* in a merely relative slidable manner. Reference numeral $G_2$ designates an output gear, and input gear $G_1$ is engaged with an upper side of output gear $G_2$. Reference numeral 36 designates a clutch and reference numeral 37 designates input means on the driving side, clutch 36 and input means 37 being rotatably mounted on a holding shaft 39 of a bracket 38 connected with support member 32. A part of bracket 38 is positioned adjacent one end face of the input gear $G_1$ and a part of clutch 36 is positioned adjacent the other end face of the input gear $G_1$, such that the upward escape of shaft portion 28*a* is permissible. That is to say, even though roller shaft 28 may be moved reciprocally in the direction of axis P, such movement does not change the position of input gear $G_1$ and shaft 28 always is under a geared condition.

Figure 3:
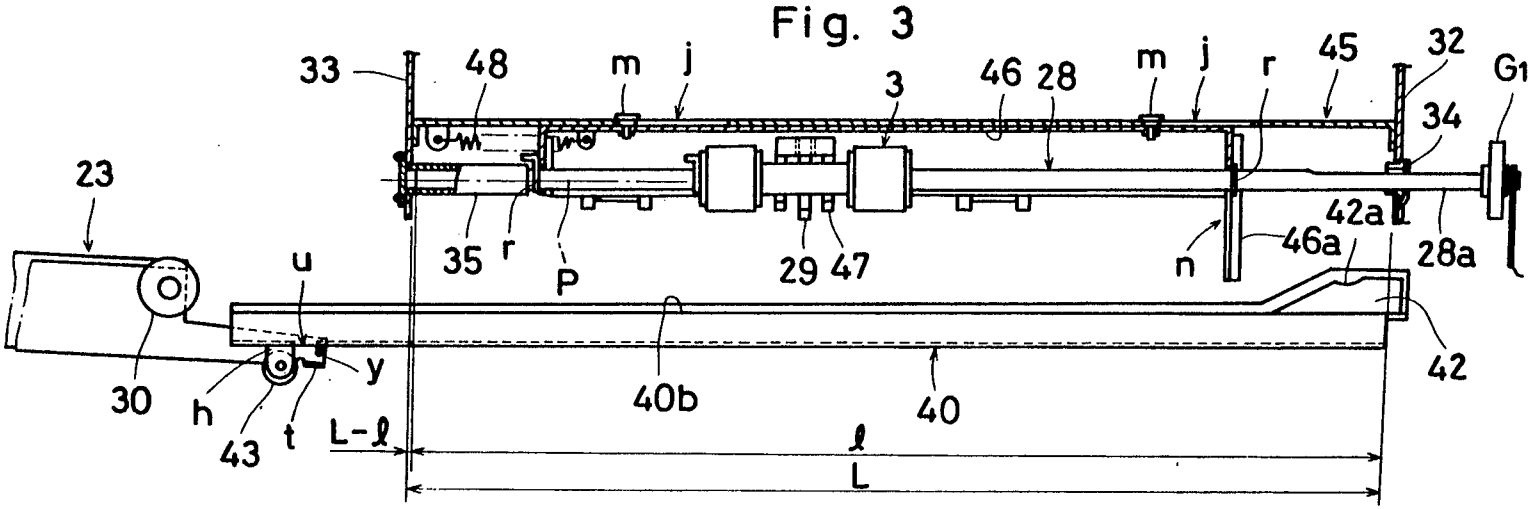
FIGS. 3 to 5 are views showing different stages of charging the paper-housing vessel.
Figure 4:
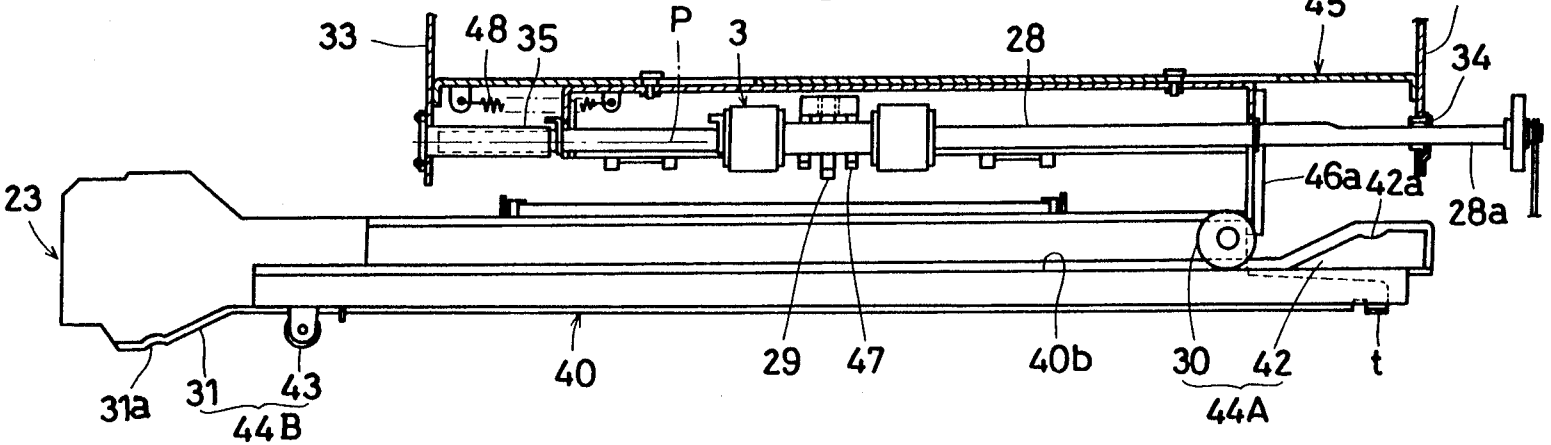

Referring to FIGS. 2 to 4, reference numeral 40 designates opposite C-shaped guide members each provided with a rib supporting and guiding a respective roller 30 of vessel 23. Guide members 40 are mounted on bracket members 41 (see FIG. 6) mounted on portion 4 by screws (f).

A supported member 42 is provided on the downstream side, in the direction of charging of vessel 23, of each of the guide members 40 for elevating rollers 30 of the vessel 23 in an upwardly inclined direction after the paper-supplying portion 4 has been charged with the vessel 23. A tongue member (h) extends from the upstream end, in the direction of charging the vessel 23 of each guide member 40 and projects downwardly to support a roller 43 for contacting and supporting a lower surface on a respective side, in the paper-supplying direction, of the vessel 23 and including cam members 31.

Roller 30 on the vessel or cassette 23, supported member 42 on the guide member 40, cam member 31 on the vessel or cassette 23 and roller 43 on the guide member 40 have the function of lifting up or elevating the vessel or cassette 23 in an upwardly inclined direction and supporting the vessel or cassette 23 at four points at the exact point in time when the charging of the cassette 23 into portion 4 has just been completed. That is to say, support structures (one example of transfer means) 44A, 44B are adapted to lift up the cassette 23 in the upwardly inclined direction and press the surface of the paper against the paper-supplying roller 3 and the sensor 29. Thus, member 42 moves roller 30 upwardly, and member 31 and moves roller 43 upwardly as soon as the vessel or cassette is charged entirely into a portion 4.

The supported members 42, 31 of support structures 44A, 44B on one side in the paper-supplying direction Q are provided with concave recesses 42*a*, 31*a* within which the respective rollers 30, 43 are engaged when the vessel is charged into portion 4 to a desired position, thereby suppressing movement of the vessel 23 charged into portion 4 in the direction of axis P.

Figures 10A, 10B:
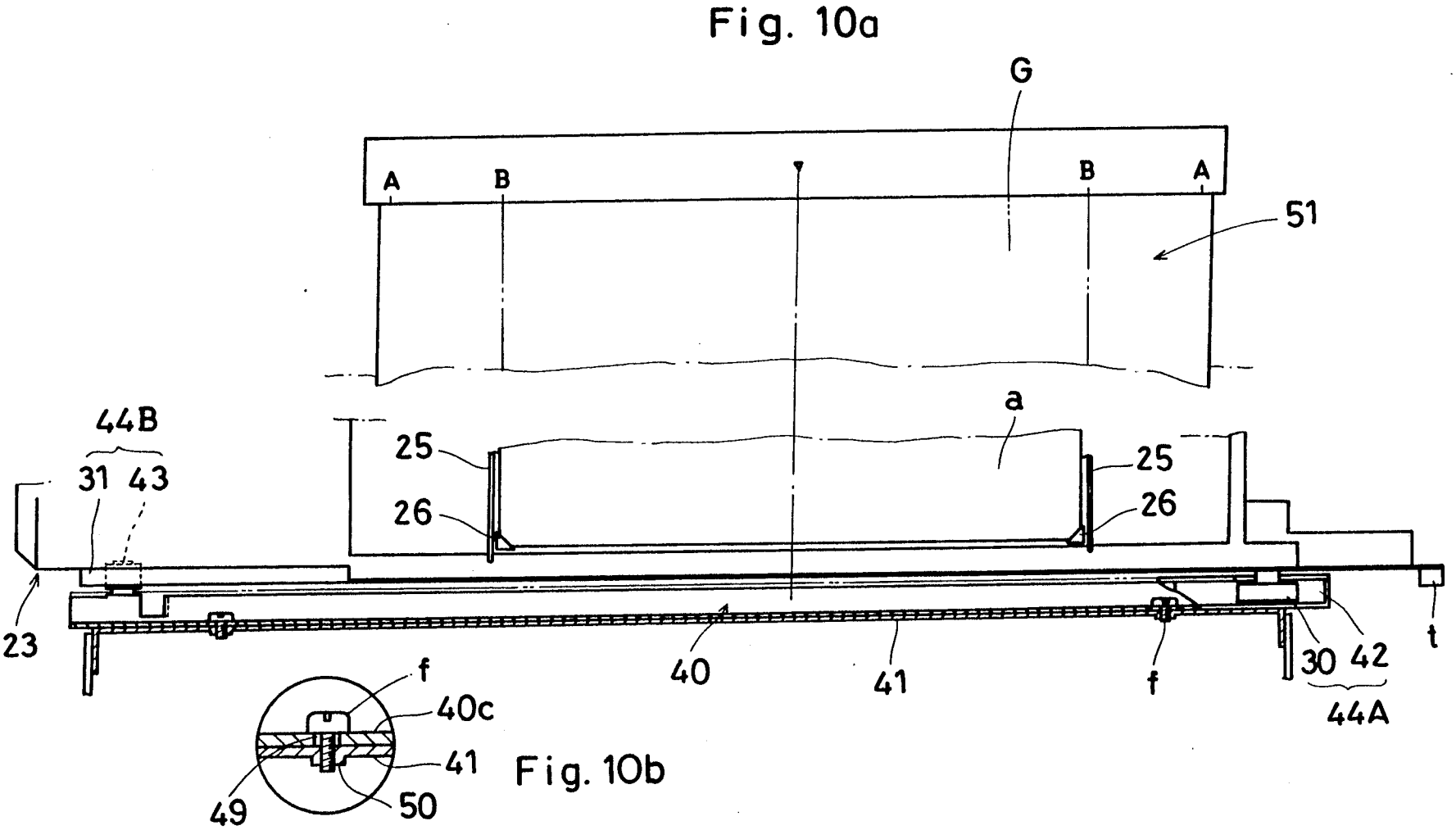
FIGS. 10*a* and 10*b* respectively are a developed view showing a condition of regulation of optic axes of a manuscript and the paper and a partial enlargement thereof.

In addition, the guide members 40 forming two sets of support structures 44A, 44B on each respective side, in the paper-supplying direction Q, are adapted to be changed in position in the direction of axis P and fixed thereat. In detail, as shown in FIGS. 2 and 10, a vertical plate or flange 40*c* of each guide member 40 is provided with elongated holes 39 spaced at appointed intervals in the direction of axis P. Each bracket 41 is provided with threaded holes 50 corresponding to holes 49, and the screws (f) extend through holes 49 and are threaded into holes 50. Thus, the position of the supported member 42 provided with the concave recess 42*a* for the roller 30 may be changed in the direction of axis P. Simultaneously, the position of roller 43 fitting into concave recess 31*a* of the supported member 31 can be changed. Thereby, the relative position at which the vessel 23 is seated in portion 4 can be changed by changing the relative longitudinal positions of guide members 40 relative to portion 4. In other words, it is possible to regulate or ensure that the optical axis or path corresponding to the center in the direction of the width of an original G placed on a contact glass 51 of the body 2 coincides with the center in the direction of the width of paper (a).

This regulation of the optical path relative to the paper center can be achieved by changing the positions of guide members 40 for each paper-supplying portion 4.

In addition, the supported members 31 may be provided on both sides at the downstream side in the direction of charging of the vessel 23, the rollers 30 may be provided on both sides at the upstream side in the direction of charging of the vessel 23, the rollers 43 may be provided at the downstream side in the direction of charging of the vessel, and the supported members 42 may be provided at the upstream side in the direction of charging of the vessel. Also, cam members may be provided at the downstream side and the upstream side on the guide member 40, and the rollers may be provided on the downstream side and the upstream side of the vessel 23. Alternatively, the construction may be reversed.

And, although the supported members 31, 42 of the two support structures 44A, 44B corresponding to one guide member 40 are provided with the concave recesses 31*a*, 42*a*, only at least one support structure 44A or 44B need have this construction for suppressing the movement of the vessel 23 to enable regulation of optical path to coincide with the center in the direction of the width of the paper.

Referring to FIGS. 2 to 5 and FIG. 8, reference numeral 45 designates a plate-like member provided on an upper side of paper-supplying roller 3 extending between the pair of supporting members 32, 33. Plate-like member 45 is provided with elongated holes (j) extending in the direction of the axis P of the shaft of the paper-supplying roller 3.

Reference numeral 46 designates a movable member in which are threaded screws (m) that extend through and are movable along holes (j). Portions 46*a*, 46 *b* on opposite ends of member 46 are bent downwardly and are provided with engaging portions (n) with which the paper-supplying roller shaft 28 is engaged from below. Receiving seats (r) are mounted on the shaft 28 so as to engage with outer surfaces of the bent portions 46*a*, 46*b*. Thus, the paper-supplying roller shaft 28 and the member 46 integrally supporting the paper-supplying roller 3 are adapted to be movable in the direction of the axis P by an amount equal to the length of a hole (j).

The length of the bent portion 46*a* on the downstream side, in the direction of charging the paper-housing vessel, of the member 46 is such that the upper surface of the paper may be brought into contact with the downstream side, in the direction of charging the paper-housing vessel, of the vessel 23 before it is brought into contact with the sensor 29. The center in the direction of the width of the paper (a) is made to almost coincide with the center in the longitudinal direction of the paper-supplying roller 3 in the direction of the axis P when the downstream side of the paper-housing vessel 23 is brought into contact with the bent portion 46*a*.

Reference numeral 47 designates paper-pressing guides provided on the member 46 at positions corresponding to midway portions and adjacent opposite ends of the roller 3, and the sensor 29 is disposed between the paper-pressing guides 47 at the midway or middle portion of roller 3.

Reference numeral 48 designates position-returning means installed between the plate-like member 45 and the member 46 for returning the paper-supplying roller 3 to an initial position. Positioning-returning means 48 moves the assembly of the member 46, shaft 28 and roller 3 in the direction of pulling out of the vessel to a position where the screws (m) are engaged with end portions of the holes (j) in the position-returning means 48, this being the initial position (see FIG. 3).

Stoppers (t) are provided at opposite sides of the downstream end, in the charging direction of the vessel 23, and are bent outwardly. A stopper tongue piece (y), at an upstream end of a lower plate portion 40*a* of each guide member 40, is cut out and bent downwardly to form an opening (u) for passing downwardly therethrough a respective stopper (t).

The charging of a paper-supplying portion 4 with a respective paper-housing vessel 23 is carried out as follows:

As shown in FIG. 3, the paper-housing vessel 23 is moved in the direction of charging housing vessel under the condition that the stoppers (t) are passed downwardly through the openings (u) and vessel 23 is moved in the charging direction. As shown in FIG. 4, the rollers 30 of the vessel 23 are placed on upper plate portions 40*b* of the guide members 40. Thus, the downstream end of the vessel 23 is supported by rollers 30 resting on guide members 40 and the upstream end of vessel 23 is supported by lower surfaces at opposite sides thereof resting on rollers 43 on the guide members 50. Thus, vessel 23 is pushed in the direction of charging while being supported at four points. Furthermore, the altitude position of the guide members 40 is set so that the paper (a) within the paper-housing vessel 23 will not be brought into contact with the paper-supplying roller 3 and the sensor 29 during such pushing of vessel 23.

Figure 5:
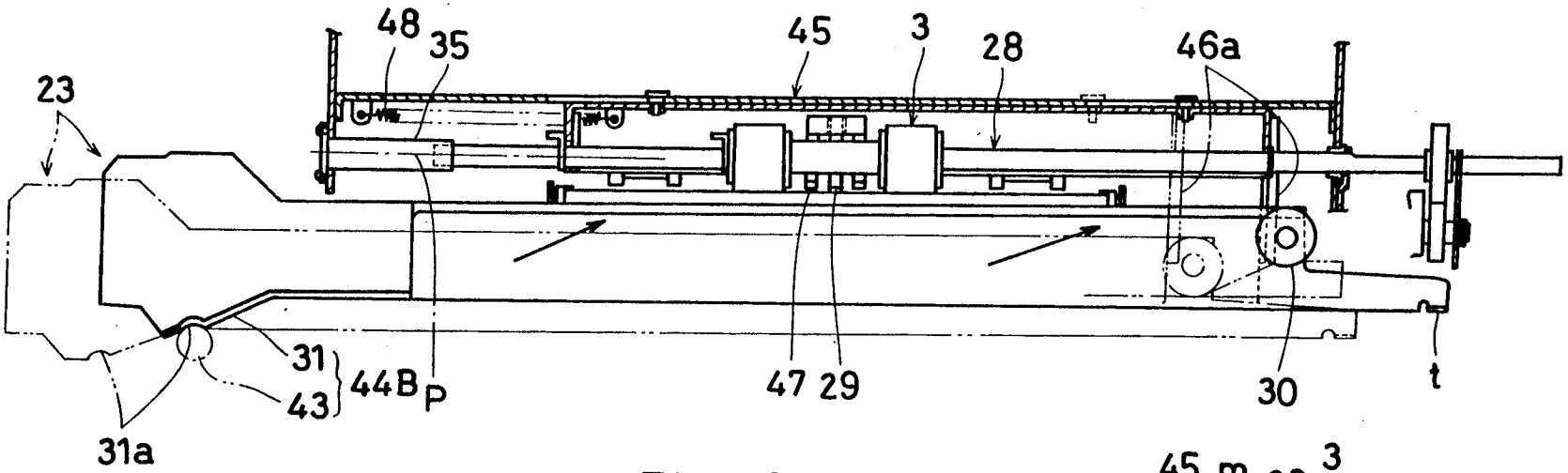
Figure 6:
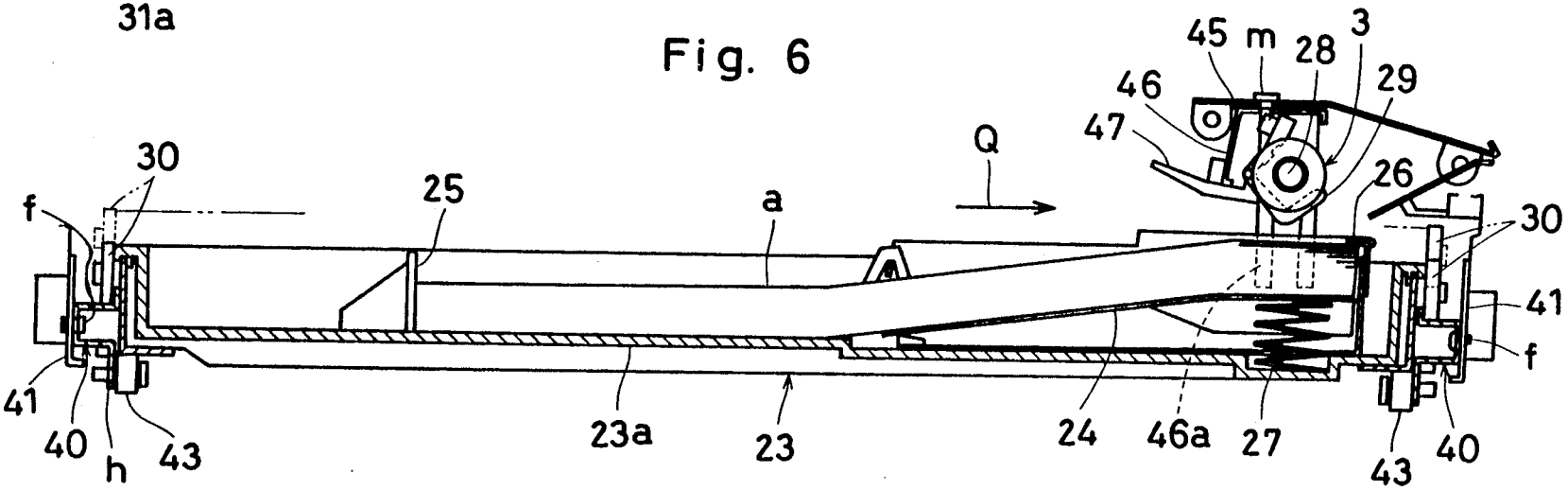
FIG. 6 is a sectional view showing a condition of the paper-housing vessel during the charging process.
Figure 7:
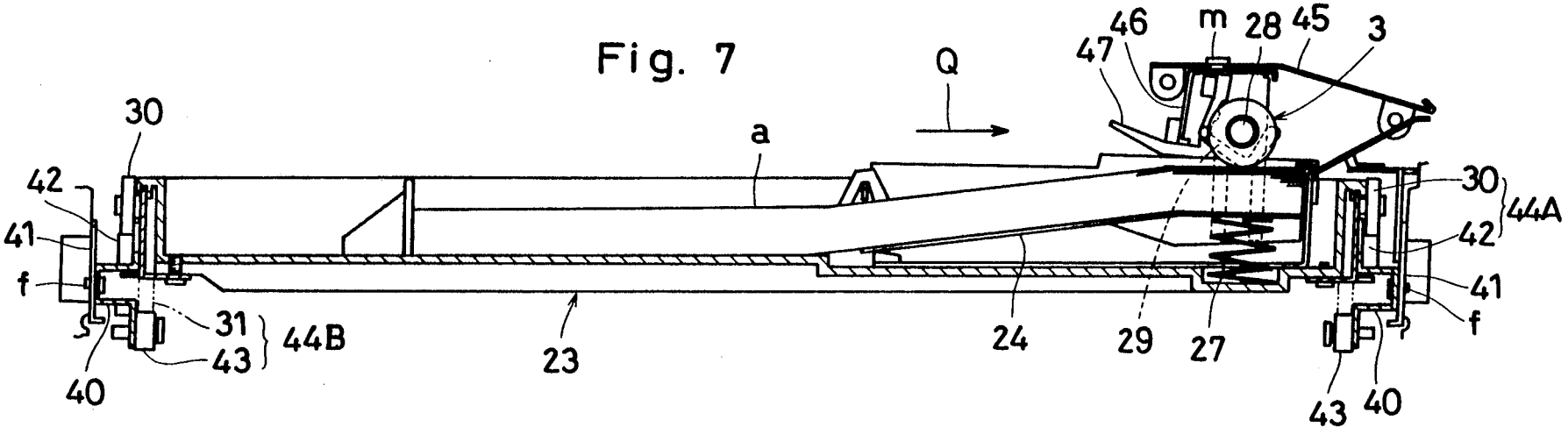
FIGS. 7 and 8 are sectional views showing a paper-supplying portion charged with the paper-housing vessel.

When the downstream end of the vessel 23 comes into contact with the bent portion 46*a*, as shown in FIG. 4, then further pushing causes the paper-supplying roller shaft 28, the paper-supplying roller 3, the sensor 29 and the member 46 to be moved in the direction of charging integrally with the vessel 23 against the force of position-returning means 48. Rollers 30 move upwardly along members 42 and members 31 move upwardly over roller 43 substantially at the same time. Thereby, cassette 23 is lifted up in an inclined upward direction of parallel movement and the upper surface of the paper within the vessel 23 is brought into contact with the sensor 29 and is pressed against the roller 3, as shown in FIGS. 5, 7 and 8.

Finally, the rollers 30, 43 are moved into the concave recesses 42*a*, 31*a* of the members 42, 31 of two sets of structures 44A, 44B, to thereby suppress movement of the vessel 23 charged into the paper-supplying portion 4. Also, even through the shaft 28 is moved, the input gear $G_1$ is not moved and remains engaged with the output gear $G_2$.

Figure 9:
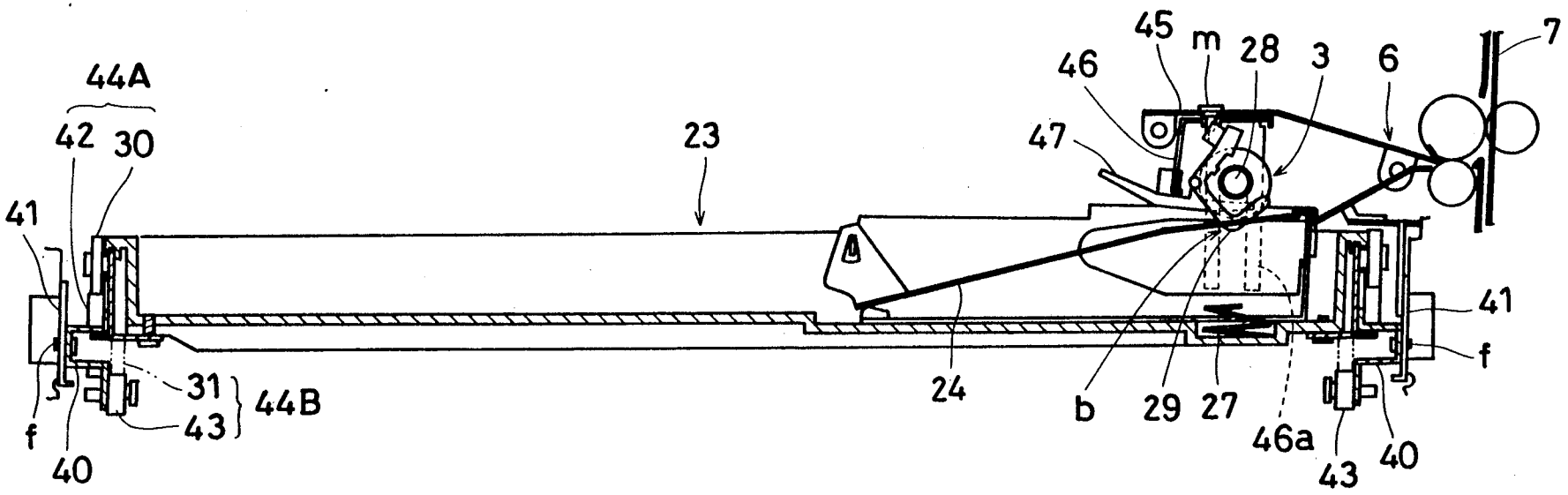
FIG. 9 is a sectional view showing a condition that an absence of paper is detected.

Upon exhausting the papers (a) within the vessel 23, the opening (b) no longer is closed by the paper (a) and the sensor 20 falls into the opening (b), as shown in FIG. 9, to operate a paper-absence alarm lamp or the like (not shown).

The paper-housing vessel 23 is pulled out of the paper-supplying portion 4 by operations opposite to the above described charging operation. That is to say, upon pulling out or withdrawing vessel 23, the vessel 23 is moved in an inclined downward direction and the roller 3, the shaft 28, the sensor 29 and the member 46 are integrally moved to the initial position, while the upper surface of the paper becomes separated from the paper-supplying roller 3 and the sensor 29, or the carrier plate 24 is separated from the paper-supplying roller 3 and the sensor 29 when no paper is present in the vessel.

During charging or withdrawal of the vessel 23, the outer end or pulling-out side of the vessel 23 freely hangs down, whereby the downstream end in the charging direction of the vessel 23 is apt to be lifted up. However, the downstream end of the vessel 23 is prevented from being lifted up by the stoppers (t) engaging with the lower surfaces of the lower plate portions 40*a* of the guide members 40. In addition, the vessel 23 is prevented from slipping out of the portion 4 by the stoppers (t) engaging with the stopper tongue pieces (y). Furthermore, although the member 46 is connected with the shaft 28 of the paper-supplying roller 3 in the preferred embodiment, the member 46 may be connected with the roller 3 itself.

Figure 11:
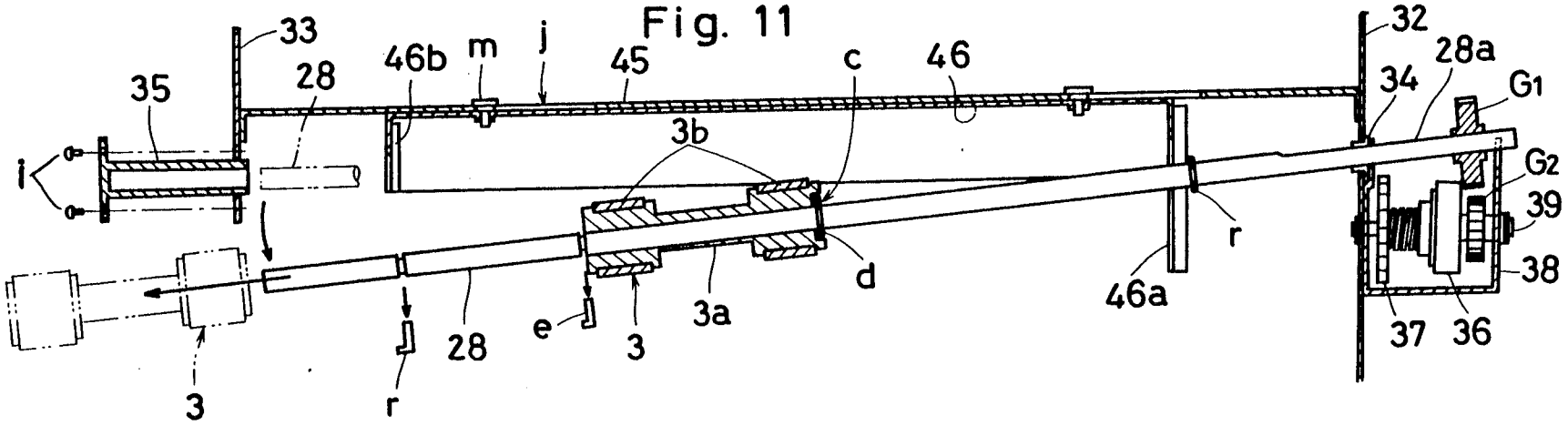
FIG. 11 is a view illustrating an operation of pulling a paper-supplying roller from a paper-supplying roller shaft.

With the above described construction, as shown in FIG. 3, a distance l from the inner surface of the supporting member 32 adjacent one end of the shaft 28 to the shaft end on the other side of the shaft 28 is slightly smaller than a distance L between the inner surfaces of the pair of supporting members 32, 33 when the shaft 28 provided with the roller is returned to the initial position by the energizing force of the position-returning means 48. That is, a gap having a side of (L −l) is formed between the shaft end on the other side of the shaft 28 and the inner surface of the supporting member 33 on such other side. Also, the bearing 35 supporting the shaft end of such other side of the shaft 28 is fixed with screws (i) so as to be pulled out of the supporting member 33 (see FIG.11). With such the construction, such end portion of the shaft 28 can freely hang down, with the bearing 34 as a center, by removing screws (i) and removing bearing 35. Thus, roller 3 can be pulled off of the shaft 28 by removing the slip-preventing member (e) and the receiving seat (r).

Figure 12:
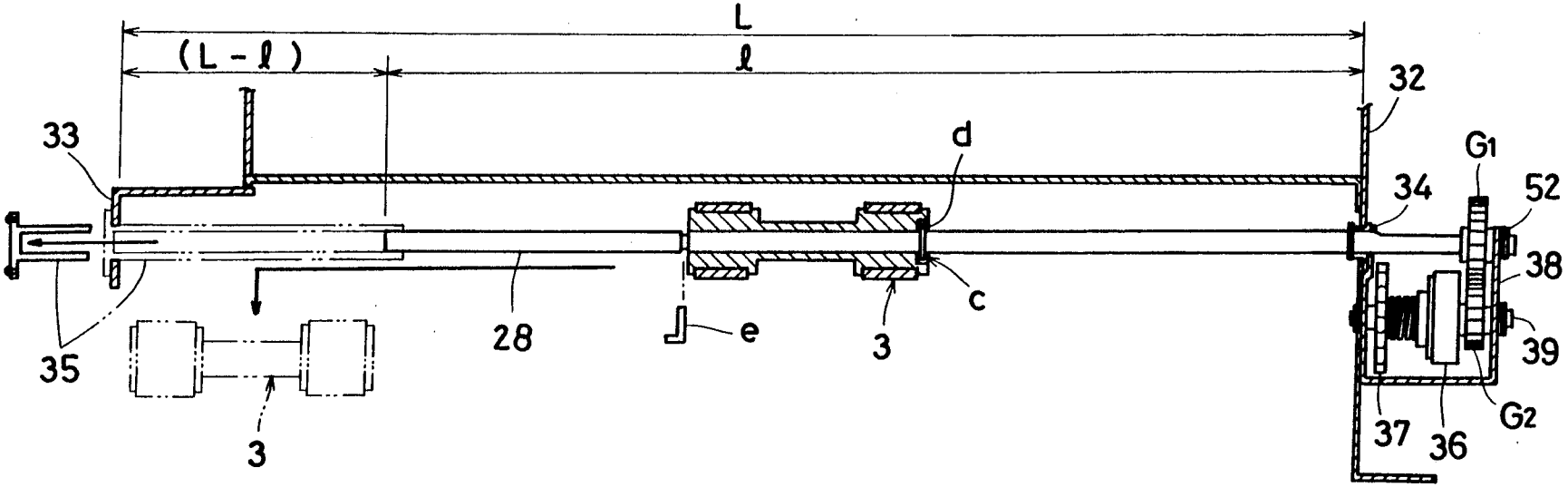
FIG. 12 is a view showing the operation of pulling a paper-supplying roller from a paper-supplying roller shaft according to another preferred embodiment.
Figure 13:
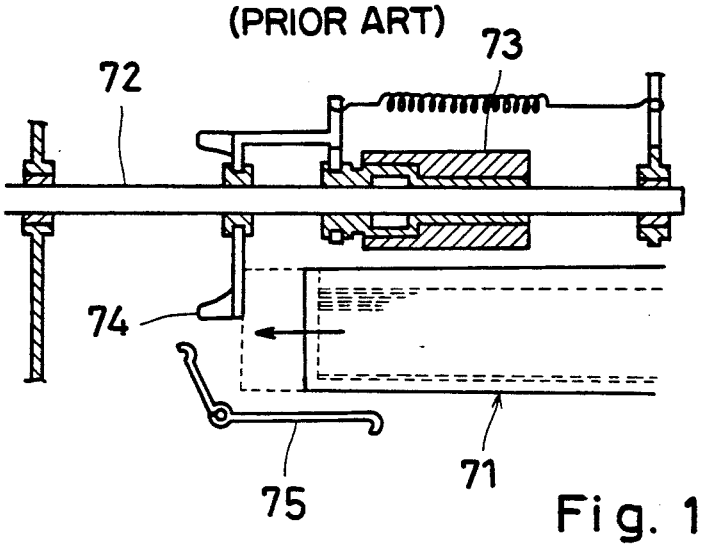
Fig. 13 (PRIOR ART)
FIG. 13 is a view of a conventional arrangement during a charging process.
Figure 14:
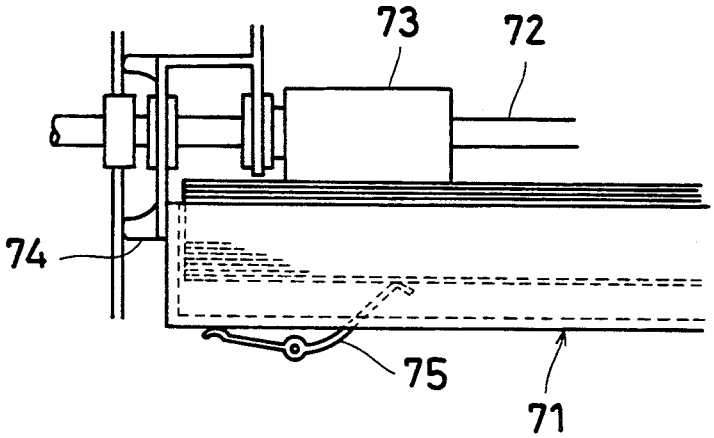
Fig. 14 (PRIOR ART)
FIG. 14 is a similar view at the end of charging.
Figure 15:
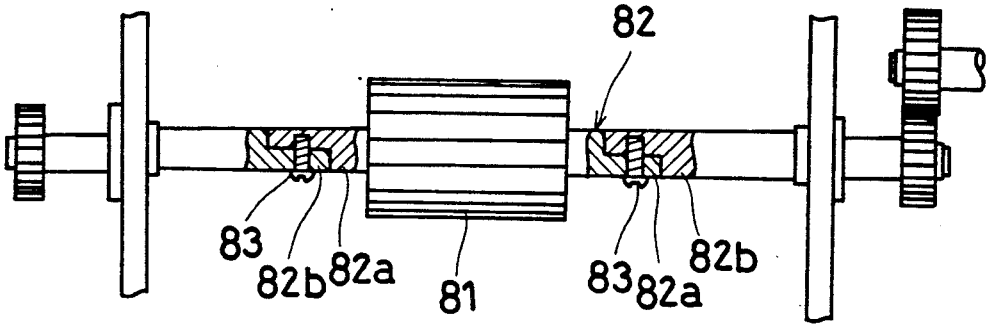
Fig. 15 (PRIOR ART)
FIG. 15 is a view showing structure of a known paper-supplying roller shaft.

FIG. 12 shown a pivoting construction according to another preferred embodiment of the paper-supplying roller shaft. This construction is characterized in that the dimension (L −l) from the shaft end on the other side of the shaft 28 to the inner surface of the supporting member 33 on such other side is set so as to be larger than the length in the direction of the shaft of the roller 3. With such the construction, the roller 3 can be pulled out through the gap between the end of the shaft 28 and the inner surface of the supporting member 33. Thus, this construction is suitable for an arrangement in which the bracket 38 is provided with bearing 52, and two points of the shaft end portion are supported to prevent the shaft 28 from hanging downwardly.

In addition, in the pivoting construction of the roller 3 shown in FIG. 3, if the bracket 38 is provided with the bearing 52 supporting shaft 28, and the gap having the size of (L −l) is formed between the shaft end on the other side of the shaft 28 and the inner surface of the supporting member 33 on such other side, when the bearing 35 is pulled away and the shaft 28 is moved in a direction opposite to the pulling-out direction of the bearing 35, the roller 3 can be pulled off of the shaft 28 by moving the roller parallel to shaft 28 without inclining the latter. In such case, since the bent portion 46*b* of member 46 on the upstream side, in the direction of charging, would interfere with the pulling-out of the roller 3, the bent portion 46*b* and the receiving seat (r) that has been engaged with the bent portion 46*b* may be omitted.

As above described, according to the invention, the paper-housing vessel is provided with the paper-separating clicks pressing the paper at both corners on the downstream side in the paper-supplying direction of the paper, and energizing means lift up the carrier plate on the side of the paper-separating clicks. The vessel and the paper are lifted up in an inclined upward direction during charging of the paper-supplying portion with the paper-housing vessel to press the upper surface of the paper against the roller. That is to say, breakage and side-ways shifting of the paper within the paper-housing vessel can be effectively prevented during the time when the vessel is being charged and withdrawn, in spite of the vessel being moved in the direction of the axis of the paper-supplying roller.

Since the paper-housing vessel itself is provided with the energizing means for pressing the paper, the optimum pressing force corresponding to the size of the paper can be given to the paper in every vessel, and thus the paper-supplying capacity can be improved.

According to the second invention, regulation between the paper within the paper-housing vessel and the image-forming optical axis can be easily achieved by changing the position where the paper-supplying portion is charged with the paper-housing vessel.

According to the third invention, since the length of the paper supplying roller shaft is set so as to form a gap between an end portion of the shaft and a supporting member and the bearing supporting such end portion of the shaft can be pulled out of the supporting member, the paper-supplying roller can be easily pulled off of the shaft, and also the installation of the roller onto the shaft likewise easily can be achieved.

We claim:

1. In a paper-supplying device for use in an image-forming apparatus wherein a paper-supplying portion is charged with a paper-housing vessel by moving the latter in the direction of a rotary axis of a shaft of a paper-supplying roller, the improvement comprising:

said paper-housing vessel being provided with paper-separating clicks for pressing paper housed in said vessel at opposite corners thereof on a downstream side in a paper-supplying direction of the paper, a carrier plate for placing the paper thereon, and energizing means for lifting said carrier plate upwardly toward said paper-separating clicks;

means for moving said paper-supplying roller in the direction of said rotary axis of said shaft thereof;

transfer means for lifting said vessel in an upwardly inclined direction to press the paper against said paper-supplying roller when said paper-supplying portion is charged with said vessel;

a member, movable into contact with said vessel before a surface of the paper is brought into contact with said roller and movable in the infection of charging said vessel, connected with said roller in a relatively rotatable manner; and position-returning means for returning said member to an initial position.

2. The improvement claimed in claim 1, wherein said transfer means comprises a support structure supporting said vessel at two positions on opposite sides thereof on a downstream end thereof in the direction of charging of said vessel and at two positions on opposite sides thereof on a upstream end thereof in the direction of charging of said vessel, said support structure comprises at each said position a roller and a supported member acting upon said roller to lift said vessel in said upwardly inclined direction as soon as said paper-supplying portion is charged with said vessel.

3. The improvement claimed in claim 2, wherein said supported member in at least one of said positions is provided with a concave recess in which the respective said roller is received when said paper-supplying portion is charged with said vessel, thereby to suppress movement of said vessel in the direction of charging thereof.

4. The improvement claimed in claim 3, wherein said supported member of the respective said roller of said at least one of said positions of said support structure is movably positioned in the direction of charging of said vessel.

5. The improvement claimed in claim 1, comprising a plurality of said paper-supplying portions to be charged with respective paper-housing vessels.

6. The improvement claimed in claim 1, wherein opposite ends of said shaft are rotatably mounted by respective bearings on a pair of supporting members, such that said shaft and said roller are movable in the axial direction together when said paper-supplying portion is charged with said vessel, a dimension from an inner surface of a first said supporting member at a first end of said shaft to a second end of said shaft being smaller than a dimension between inner surfaces of said pair of supporting members, and said bearing supporting said shaft end at said second end of said shaft being capable of being pulled out of said supporting member at said second end of said shaft.

7. The improvement claimed in claim 1, wherein said carrier plate has therein an opening to be closed by means of the paper placed thereon and said member is provided with a sensor swingable around said axis of said shaft to fall through said opening when no paper is present on said carrier plate.

8. The improvement claimed in claim 7, wherein opposite ends of said shaft are rotatably mounted by respective bearings on a pair of supporting members, such that said shaft and said roller are movable in the axial direction together when said paper-supplying portion is charged with said vessel, a dimension from an inner surface of a first said supporting member at a first end of said shaft to a second end of said shaft being smaller than a dimension between inner surfaces of said pair of supporting members, and said bearing supporting said shaft end at said second end of said shaft being capable of being pulled out of said supporting member at said second end of said shaft.

9. The improvement claimed in claim 7, wherein said transfer means comprises a support structure supporting said vessel at two positions on opposite sides thereof on a downstream end thereof in the direction of charging of said vessel and at two positions on opposite sides thereof on a upstream end thereof in the direction of charging of said vessel, said support structure comprises at each said position a roller and a supported member acting upon said roller to lift said vessel in said upwardly inclined direction as soon as said paper-supplying portion is charged with said vessel.

10. The improvement claimed in claim 9, wherein said supported member in at least one of said positions is provided with a concave recess in which the respective said roller is received when said paper-supplying portion is charged with said vessel, thereby to suppress movement of said vessel in the direction of charging thereof.

11. The improvement claimed in claim 10, wherein said supported member or the respective said roller of said at least one of said positions of said support structure is movably positioned in the direction of charging of said vessel.

12. The improvement claimed in claim 11, comprising a plurality of said paper-supplying portions to be charged with respective paper-housing vessels.

13. In a paper-supplying device for use in an image-forming apparatus wherein a paper-supplying portion is charged with a paper-housing vessel by moving the latter in the direction of a rotary axis of a shaft of a paper-supplying roller, the improvement comprising:

opposite ends of said shaft are rotatably mounted by respective bearings on a pair of supporting members, a dimension from an inner surface of a first said supporting member at a first end of said shaft to a second end of said shaft being smaller than a dimension between inner surfaces of said pair of supporting members; and said bearing supporting said shaft end at said second end of said shaft being capable of being pulled out of said supporting member at said second end of said shaft in the same direction in which said vessel is pulled-out from said paper supplying portion, and said roller is axially removable from said shaft.

14. The improvement claimed in claim 13, wherein a dimension from said shaft end at said second end of said shaft to said inner surface of said supporting member at said second end of said shaft is larger than the length in the direction of said axis of said roller.

15. The improvement claimed in claim 13, wherein said shaft is adapted to be movable in a direction, opposite to the direction of pulling out of said bearing at said second end of said shaft, by an amount such that the dimension from said shaft end at said second end of said shaft to said inner surface of said supporting member at said second end of said shaft is larger than the length, in the direction of said axis, of said roller.

16. The improvement claimed in claim 13, further comprising means adjacent said second end of said shaft for fixedly mounting said roller in position on said shaft.

* * * * *